United States Patent [19]

Duriez et al.

[11] 4,081,058

[45] Mar. 28, 1978

[54] CONTROL APPARATUS

[76] Inventors: Jean Duriez, 119, rue J. Gielee a Lille (59); Jean Evin, Hameau de la Becque a Avelin (59), both of France

[21] Appl. No.: 632,845

[22] Filed: Nov. 17, 1975

[51] Int. Cl.[2] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,773,146 | 11/1973 | Dixon, Jr. et al. | 187/29 |
| 3,777,855 | 12/1973 | Boyldew et al. | 187/29 |
| 3,815,711 | 6/1974 | Hoelscher | 187/29 |
| 3,893,695 | 7/1975 | Rickert | 187/29 X |

*Primary Examiner*—Robert K. Schaefer
*Assistant Examiner*—W. E. Duncanson, Jr.
*Attorney, Agent, or Firm*—Cameron, Kerkam, Sutton, Stowell & Stowell

[57] ABSTRACT

Control apparatus for regulation of the deceleration of an elevator has a comparator for two currents which are functions of the actual decrease of the velocity and the other of the desired decrease provided by a source and including means controlled by the differential current from the comparator to determine the variation of the speed of the elevator. The source is served by means causing decrease of the current that they elaborate as a function of the available distance and not of time. The invention is applicable to elevators, invalid carriers, freight carriers and similar apparatus.

5 Claims, 7 Drawing Figures

Fig. 4
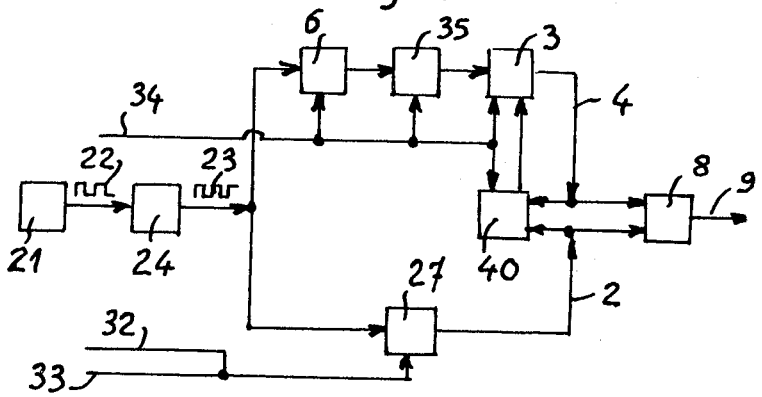
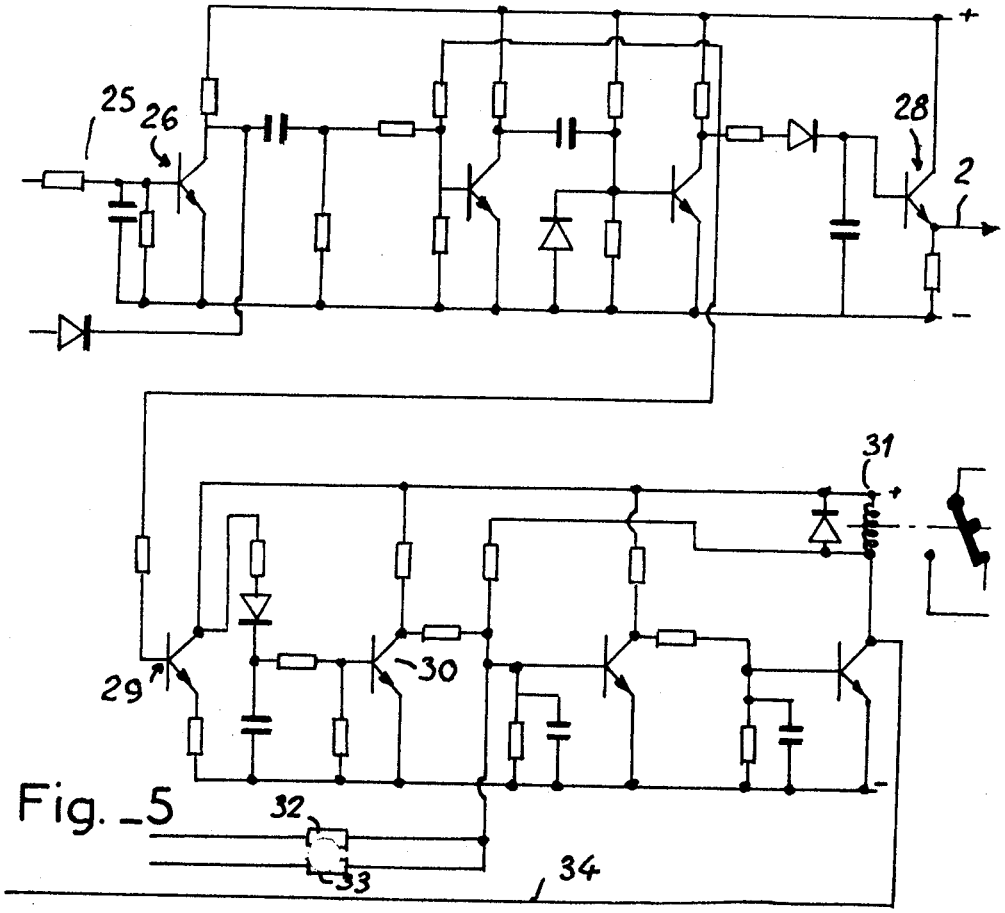
Fig. 5

CONTROL APPARATUS

BACKGROUND OF THE INVENTION

The present invention relates to control apparatus for regulation of the deceleration of a moving object just prior to its total stop during a time which can vary but over a constant distance whatever the inertia, the acceleration and the initial velocity of the moving object.

The present invention applies more particularly but not exclusively to elevators, invalid carriers, load carriers and similar apparatus which during their arrival at a predetermined distance from the platform, corresponding to the ascending or descending control being carried out, causes the emission of an order for stopping at the selected level and thus over a given distance.

To obtain this stop the apparatus must in a first period of time reduce the velocity and then in a second period of time apply a stopping brake.

To provide for the comfort of the users of the elevator, and of the sick and/or persons to undergo a surgical operation and being moved in a lift for the ill, and also so as not to brake or upset objects being transported in such apparatus, it is important that these moving elements have a regular deceleration and as slowly as possible, but sufficient so that the actuation of the stopping brake does not cause an abrupt stop. To this end, the stopping brake should only be applied at the end of displacement of the elevator, that is, when its speed is practically zero. However, this stop must nevertheless occur exactly at the level of the platform for the comfort of the users and to facilitate access of wheeled vehicles or the handling of objects in the elevator.

Certain elevators utilize only a single speed motor and a brake which is progressively actuated to slow the elevator and then stop it. The action of braking is against the inertia and the action of the motor from the beginning of the deceleration heats the structure and rapidly deteriorates the brake linings without providing a regularity of the deceleration or the stop without an abrupt change.

To decrease the time of action of the brake, other elevators utilize two speed motors which receive two distinct signals to stop them. The first signal controls the movement to low speed and the other causes the action of the brake. Unfortunately, there is a jolt caused by the change of speed in the movement of the lift and the lift can still have a rather high speed particularly if the lift is in descent and loaded and because of this the stopping is abrupt. Further, such a motor having double coils is quite costly.

In prestigious installations where the high cost of the apparatus is not a consideration, variable speed motors are used controlled by complex regulators which provice a quite regular deceleration of the elevator in comparison with the actual decrease of the speed as compared to the desired decrease as a function of time beginning with the start of the decrease of velocity and acting on the braking force and/or the current feeding the motor as soon as the difference between the actual decrease and the desired decrease passes a predetermined value.

If there is no difference between the two values, the stop would occur in the given time and over the available distance.

However, these differences occur which are inevitable and caused primarily by the differences of weight in the elevator. The stopping distance is varied and the result is a stop out of level with the platform, in accordance with the sense of the difference with an abrupt stop before the normal end of deceleration or the motor must be reenergized to maintain speed to reach the platform which greatly increases the time of response to the orders of the users.

BRIEF SUMMARY OF THE INVENTION

The present invention provides a less costly apparatus for control and regulation of the deceleration of an elevator up to its total stop during a time which can vary but over a constant distance whatever the speed, the inertia and the acceleration, positive, zero or negative of the elevator.

To this end, the apparatus includes a comparator of two voltages, one voltage being a function of the actual decrease of the speed and the other of the decrease imposed on the elevator by a control as well as means controlled by the differential voltage from the comparator to determine the variation of the speed of the lift, the apparatus further comprising means for decreasing, as a function of the available distance and not of time, the voltage representing the decrease of speed as imposed and which is applied to the comparator.

DESCRIPTION OF THE ACCOMPANYING DRAWINGS

The present invention will now be described with reference to the accompanying drawings showing a preferred embodiment and in which FIG. 1 is a block diagram of a preferred embodiment;

FIG. 4 is a schematic view of a preferred embodiment of the control apparatus; and FIGS. 5 to 7 are details of the apparatus as seen in FIG. 4.

DESCRIPTION OF THE PREFERRED EMBODIMENT

Figure 1:
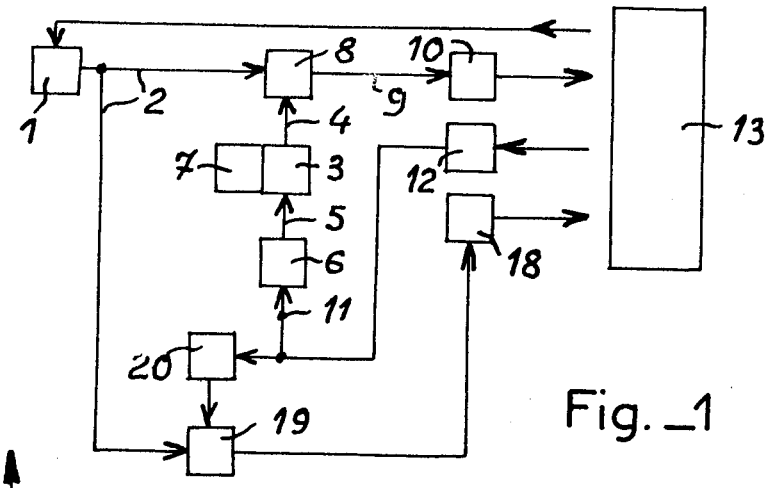

With respect to FIG. 1, it will be noted that the apparatus includes means 1 for detection of the actual variation of the speed of the lift and for translation of this information in the form of a current 2 having a voltage which is a function of these variations.

Figure 2:
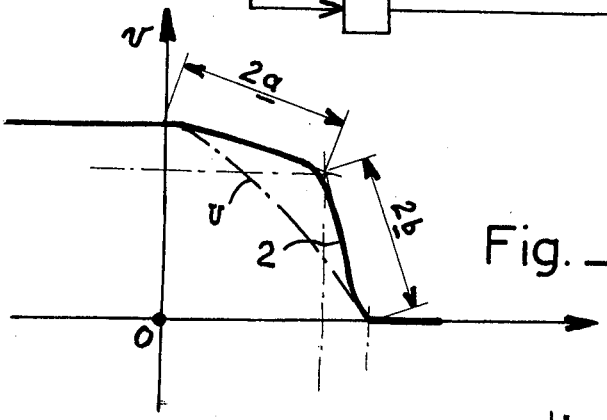
FIG. 2 shows curves of decrease of speed.
Figure 3:
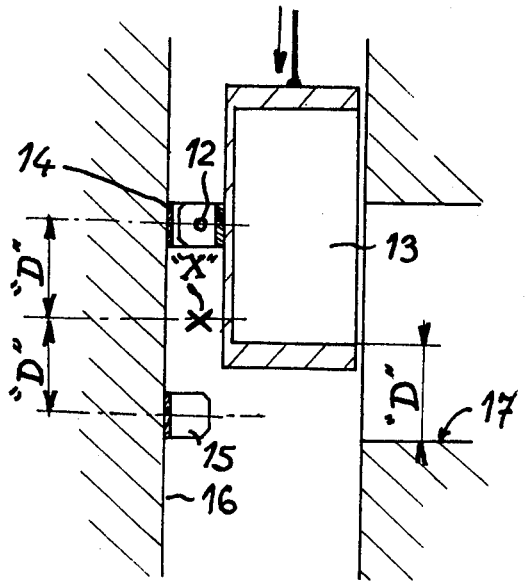
FIG. 3 is a sectional view of the cage of an elevator.
Figure 6:
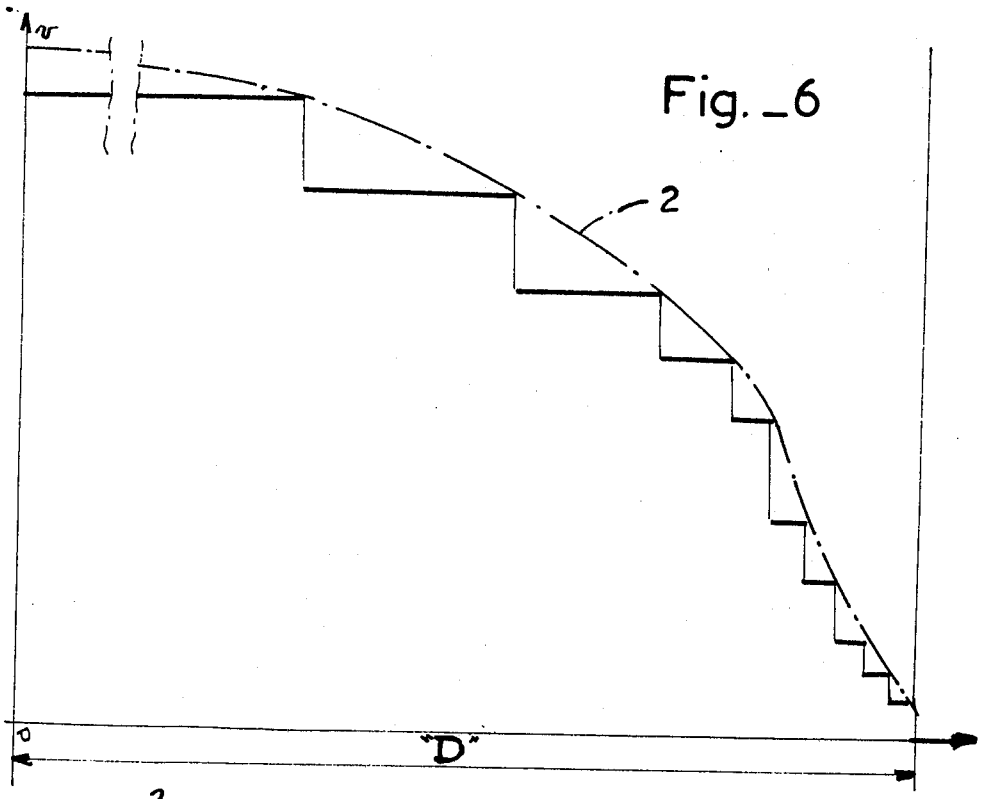
Figure 7:
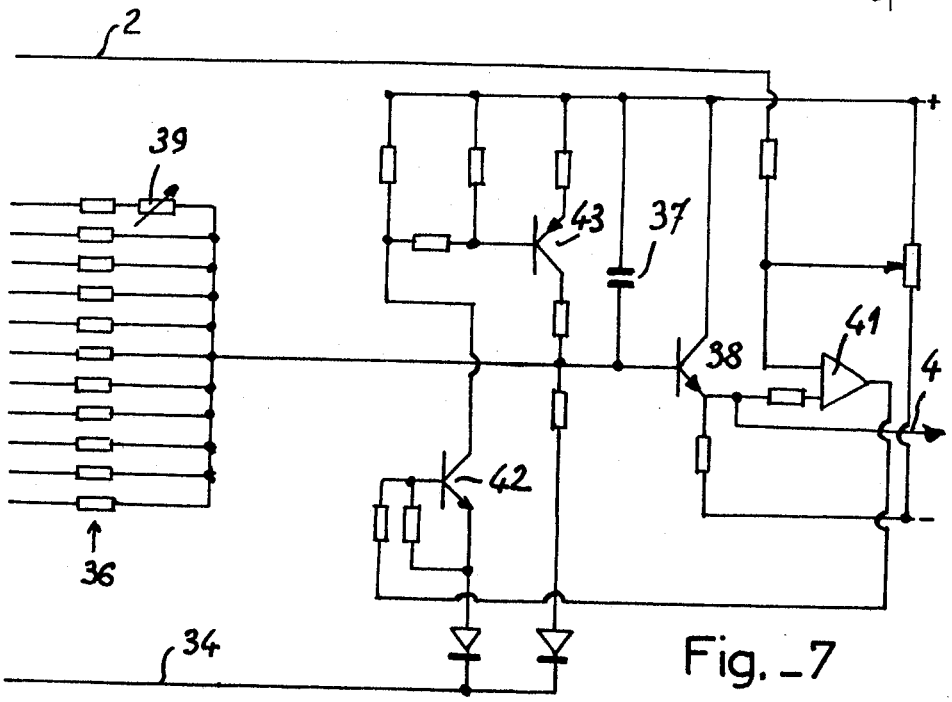

In the braking of a lift, the curve of deceleration and thus the image of the voltage obtained using a tachymetric pulley substantially corresponds to that identified by "U" in FIG. 2. However, for reasons which will be discussed hereinafter, a descriminator is used receiving a signal having a frequency proportional to the actual speed to elaborate this voltage the decrease of which then corresponds to curve 2 of FIG. 2. Curve 2 includes a portion **2*a* covering the greater part of the available distance to obtain the stop; the slope of which is generally small and is a function of the intensity of the action of the braking means utilized. The portion 2*b* of the curve covers only the remainder of the available distance and has, by reason of the manner of reading, an important length facilitating its observation for regulation. The slope of this last portion is less affected than that of the first portion by the intensity of the action of the braking means used. The apparatus of the present invention also includes means 3 or consignor elaborating a current 4 the voltage of which is a function of information 5 received from a counter 6 of the distance actually covered from the beginning of braking and information 7** relative to the desired speed and which is thus to be imposed as a function of the distance covered since the beginning of braking.

Voltage 4 will be so formed as to have a decrease similar to that of voltage 2 of FIG. 2 but will function as the distance covered and not of the time already passed.

These voltages 2 and 4, one representing the actual decrease and the other the imposed decrease are applied to a comparator 8 elaborating a differential voltage 9, controlling regulator 10 of the intensity of the means determining the variation of the speed of the elevator (not shown).

These means determine the variation of the speed of the elevator and can be of any known type such as the control of a variable speed motor and/or a braking apparatus the action of which is directly or indirectly a function of the characteristics of a current as, for example, a Foucault current brake or an electrochemical brake.

As indicated above, the essential characteristic of the present invention is that the control is not a function of time but of the distance covered. The actuation of the distance counter 6 is provided, in known way, by an outside information 11 given at a fixed distance from the stopping point "X", as for example, by means of a sensor 12 connected to the elevator 13 which at a distance "D" from point "X" senses a screen (14 or 15 in accordance with the direction of movement) fixed to the wall of shaft 16. Point "X" is determined in such a way as to cause elevator 13 to stop at the level of platform 17 corresponding to the direction of movement of the elevator.

When means 10 determining the variations of speed do not assure stopping of the elevator, a mechanical brake 18 can be utilized, the action of which at the end of movement of the lift is controlled by means 19 causing termination of voltage 2 at the end of the counting.

For security, actuation of mechanical brake 18 can also be controlled by a timer 20 adjusted for a time slightly greater than the braking time to clear all anomalies of functioning of the apparatus. The beginning of this timing is triggered parallel to the beginning of the count of the distance by sensor 12.

A preferred embodiment of means 1 and 3 of elaborating voltages 2 and 4 is shown in FIG. 4.

It comprises, mounted on the assembly of the machinery of the elevator, a reader 21 of the number of turns or fractions of turns of the motor through the intermediary, for example, of a perforated disc or a toothed disc furnishing a signal 22 of variable frequency as a function of the speed of the motor. Reader 21 is of known type such as a photo-electric cell placed opposite a luminous source the beam of which is broken intermittently by the teeth or spaces between the perforations of the disc.

The motor is connected mechanically to the lift and the number of impulses of the reader corresponds to a certain distance effectively covered by the elevator.

The distance available for slowing down of the elevator can then be translated into a certain number of impulses with the number of impulses being greater when the disc has a large number of teeth or of perforations and/or as the movement will be demultiplied.

For example, for a disc having 200 teeth turning at 1,500 turns per minute there will be a frequency of 5 kilohertz for a hoist control having a demultiplication of 1/50 equipped with a pulley having a circumference of 500 meters, the distance actually covered between two impulses will be 15/100 of a millimeter only which provides great accuracy. If it is therefore desired, as in this example, to stop the lift over a distance "D" of a meter, it would be necessary to count in all about 6,660 tops.

It should be noted that to make the apparatus useful in all installations whatever the speed, it is sufficient to choose for each installation a disc having a predetermined number of notches.

Signal 22 is placed in form 23 acceptable to the following apparatus by known means 24. For example (FIG. 5) the signal is cleared of parasitic signals 25 and then placed in form by a transistor 26.

Signal 23 is then sent to a discriminator 27 or other system defining the variation of the frequency of the signal.

For example, a circuit will be used of the type providing demodulation of the modulated frequency. A derivative controls a monostable which charges a delay, the value of which appears at the output 2 of the emitter of transistor 28.

This circuitry has the advantage of perfect adaptability to the image of the decrease of speed (FIG. 2). Actually, the variation of voltage is quite small for three quarters of the decrease of frequency (for example, from 4,000 to 1,000 Hertz) and then large at the end of loss of frequency (for example, from 1,000 to 50 Hertz).

At the end of deceleration signal 2 becomes zero. Apparatus 19 which then controls the application of mechanical brake 18 comprises, for example, a slight delay by two transistors 29, 30 of a bridge controlling relay 31 actuating the brake.

Relay 31 can also be controlled by security means 32, 33 controlling an abnormal difference between actual deceleration and the desired deceleration. Control 34 is also utilized for return to zero of the system on departure of the elevator.

In place of descriminator 27, the same information 2' can be obtained by a simple tachymetric dynamo. However, the present embodiment is preferred because it utilizes information from reader 21 required by the construction of the consignor elaborating current 4 to the image of the desired speed.

To obtain this image of the desired speed as a function of the available distance, signal 23 is sent to counter 6 of the number of impulses.

As is seen in FIG. 2, the curve of decrease of desired speed does not correspond to a straight line. Thus, a decoder 35 is used of certain portions of the counter 6 to divide the available distance into several portions. Because of this the curve of the decrease of desired speed is a succession of straight lines along the curve seen in FIG. 2.

It is advantageous to choose a succession of portions of distance of decreasing values to follow curve 2 of the voltage read after the discriminator providing great accuracy at the end of movement.

For example, if the available distance is 9,910 tops, the total distance "D" would be divided into successive portions of 5,000, 2,500, 1,200, 500, 300, 160, 80, 40, 20 and finally, 10 impulses only for a change of portion each time that the counter indicates a total number of impulses of 5,000, 7,500, 8,700, 9,300, 9,600, 9,760, 9,840, 9,900, and 9,910 impulses.

The decoder provides outputs in number equal to those of the portions which are, at the passage of the positions above of the counter, successively fed in current of the same intensity but acting differently on consignor 3 because of the fact that they are connected through a chain of resistances 36 of decreasing value so that, at the output of the consignor, the imposed image has an increasing deceleration and the last output fed meeting the least resistance short circuits the preceding outputs and cuts out the preceding consignor.

The resistance corresponding to the portion of the distance being counted provides a progressive charge to condensor 37 varying the signal 4 available on the emitter of transistor 38.

As noted above, the intensity of the action of the braking means was particularly sensitive to the portion to a of curve 2 (FIG. 2). Thus, to vary this intensity, it is sufficient to adjust the value of the first resistance or to provide in series with it, a variable resistance 39. For example, this first resistance could have a value varying from 150 to 50 kilo-ohms and the following having successive values of 22, 14, kilo-ohms, 4,700, 2,700, 1,500, 1,000, 680, and 470 ohms which would provide a progression providing a good result for the portions of distance discussed above.

Capacity 37 will obviously be adjustable as a function of the size of the first portion. In the example given, it could, for example, be 136 microfarads.

Since at the input of comparator 8 it is imperative that, at the beginning of the period of slowing down, the value of the voltage of the consignor be equal to that of the image speed, an automatic regulation is necessary. It can be provided by apparatus 40 utilizing a differential amplifier 41 and two transistors 42, 43.

What we claim is:

1. Control apparatus for regulation of the deceleration of an elevator up to full stop, in a variable time but over a constant distance whatever the inertia, acceleration and initial speed of the elevator which, upon arrival at a given distance from the stopping point, receives a signal to begin slowing down, comprising a comparator for two current functions, one for the actual decrease of speed and the other for the desired decrease of speed imposed by the consignor means controlled by the differential current from the comparator for determining the variation of the speed of the elevator, the consignor being connected to means causing a decrease of the current that it elaborates as a function of the available distance and not of time consisting of at least one counter of the distance covered from the beginning of the decrease of speed, a reader providing impulses to the counter which are responsive to the passage of crests of a member whose movement is synchronized with the actual movement of the elevator, the number of impulses being proportional to the distance covered the improvement comprising a frequency discriminator elaborating the variable voltage representing the variation of the actual speed of the elevator connected downstream of the reader transmitting frequency impulses proportional to the speed of the elevator.

2. Apparatus in accordance with claim 1 including a decoder of certain positions of the counter controlling the consignor, defining between them portions of the available distance, said decoder comprising outputs in number equal to that of the portions of the available distance, acting successively at each passage of the counter from one of the decoded positions, connecting means to a source of current of that of the outputs which will affect the regulation of the speed on the portion of the distance being counted, each output of the decoder includes a resistance before its connection to the other outputs and before entry in the consignor, the resistances of the outputs being of decreasing values following the order of connection of the outputs to the source of current.

3. Apparatus as described in claim 2, the resistance of at least the first output being a variable resistance.

4. Apparatus as described in claim 1, the consignor including a condensor, the charge of the condensor varying with the voltage at the input of the consignor, said condensor controlling a transistor, the emitter of which provides the voltage representing the desired decrease of speed.

5. Apparatus as described in claim 1, the variable voltage representing the desired deceleration is, before input in the comparator, brought to automatic means for realignment of its voltage with that representing the actual speed at the beginning of the reduction of speed.

* * * * *

UNITED STATES PATENT AND TRADEMARK OFFICE

CERTIFICATE OF CORRECTION

PATENT NO. : 4,081,058

DATED : March 28, 1978

INVENTOR(S) : Jean Duriez and Jean Evin

It is certified that error appears in the above-identified patent and that said Letters Patent are hereby corrected as shown below:

Page 1, column 1, after "[21]", insert:

--[30] Foreign Application Priority Data

November 15, 1975 France.....74.40662--

Signed and Sealed this

*Fourth* Day of *July 1978*

[SEAL]

*Attest:*

RUTH C. MASON
*Attesting Officer*

DONALD W. BANNER
*Commissioner of Patents and Trademarks*